US005752662A

United States Patent [19]

Hsu

[11] Patent Number: 5,752,662

[45] Date of Patent: May 19, 1998

[54] ATOMIZER

[76] Inventor: Chin-tien Hsu, No. 3, Alley 15, Lane 54, Fute 2nd Rd., Hsitzu Chen, Taipei Hsien, Taiwan

[21] Appl. No.: 655,435

[22] Filed: May 30, 1996

[51] Int. Cl.[6] ..... B05B 3/08

[52] U.S. Cl. ..... 239/215; 239/222.11; 239/289; 239/333; 222/333

[58] Field of Search ..... 239/214.25, 215, 239/302, 332, 375, 383, 418, 289, 222.11, 333; 261/28, 90; 221/333

[56] References Cited

U.S. PATENT DOCUMENTS

| | | | |
|---|---|---|---|
| 2,079,117 | 5/1937 | Hays | 239/222.11 |
| 2,257,807 | 10/1941 | Morse | 239/63 |
| 3,004,403 | 10/1961 | Laporte | 62/311 |
| 3,610,526 | 10/1971 | Ericson | 239/222.11 |
| 3,997,115 | 12/1976 | Licudine | 239/351 |
| 4,235,377 | 11/1980 | Davis et al. | 239/315 |
| 4,392,614 | 7/1983 | Groth et al. | 239/315 |
| 4,839,106 | 6/1989 | Steiner | 261/28 |
| 5,338,495 | 8/1994 | Steiner et al. | 261/28 |

*Primary Examiner*—Andres Kashnikow
*Assistant Examiner*—Lisa Ann Douglas
*Attorney, Agent, or Firm*—Bacon & Thomas

[57] ABSTRACT

An improved atomizer comprises an atomizing mechanism, a housing mounted over the atomizing mechanism, a rotor mounted on the housing, the rotor having a number of blades made of flexible material mounted thereon, and a delivery tube connected between a back of the rotor and the atomizing mechanism. The rotor is driven by a motor disposed in the housing and configured as a frame with a number of ribs integrally formed thereon so that fluid can be atomized and diffused through the rotor with a good effect.

3 Claims, 2 Drawing Sheets

ATOMIZER

BACKGROUND OF THE INVENTION

1. Field of the Invention

The present invention relates to an improved atomizer, more particularly to an atomizer having a rotor with vanes made of flexible material mounted therearound and a delivery tube to meet the needs of safety and efficient atomizing and diffusion.

2. Description of Related Art

Atomizers have been put into various uses, such as in sports, where atomizers are used to cool and refresh players during intervals of rest. A kind of conventional atomizer has a structure where a nozzle is disposed over a container and a pressure trigger is provided in a front of the nozzle to pressure-feed a fluid, e.g. water to be atomized from the container. This kind of conventional atomizer generally is used in certain fields such as delivery of a cleaning agent due to its limited distance of atomizing. When used in sports or other outdoor occasions with wind, this kind of atomizer lacks good efficiency. Another kind of conventional atomizer has been improved to add a fan in front of the nozzle so that the efficiency of diffusion can be increased by means of wind power provided by the fan. This kind of atomizer has a disadvantages that some of the fluid is sprayed on to a back of the fan and some is sprayed randomly due to the improper position of the fan's disposition. To overcome above problems, another kind of atomizer is proposed as in Applicant's U.S. patent application Ser. No. 08/593,925 which adds a delivery tube connected between a jet head in front of the fan and the nozzle. This atomizer further uses a frame disposed around the fan to assure safety. However, this results in a complex structure and a higher cost for manufacture.

The present invention provides an improved atomizer to mitigate and/or obviate the aforementioned problems.

SUMMARY OF THE INVENTION

One object of the present invention is to provide an improved atomizer having an rotor with vanes made of flexible material mounted therearound and a delivery tube to meet the needs of safety and efficient atomizing and diffusion.

In accordance with one aspect of the present invention, the atomizer comprises an atomizing means, a housing mounted over the atomizing means; a rotor mounted on the housing, said rotor having a number of blades made of flexible material mounted thereon, and a delivery tube connected between a back of the rotor and the atomizing means.

In accordance with another aspect of the present invention, the atomizing means is an atomizing head with a spray nozzle mounted on a container.

In accordance with a further aspect of the present invention. The atomizer as claimed in claim 1, wherein said rotor is driven by a motor disposed in the housing.

In accordance with still a further aspect of the present invention, the rotor is configured as a frame with a number of ribs integrally formed thereon.

In accordance with still a further aspect of the present invention, the delivery tube has two ends, one is mounted to the spray nozzle and the other has an orifice mounted in front of the housing.

Other objects, advantages and novel features of the invention will become more apparent from the following detailed description when taken in conjunction with the accompanying drawings.

DETAILED DESCRIPTION OF PREFERRED EMBODIMENT

Figure 1:
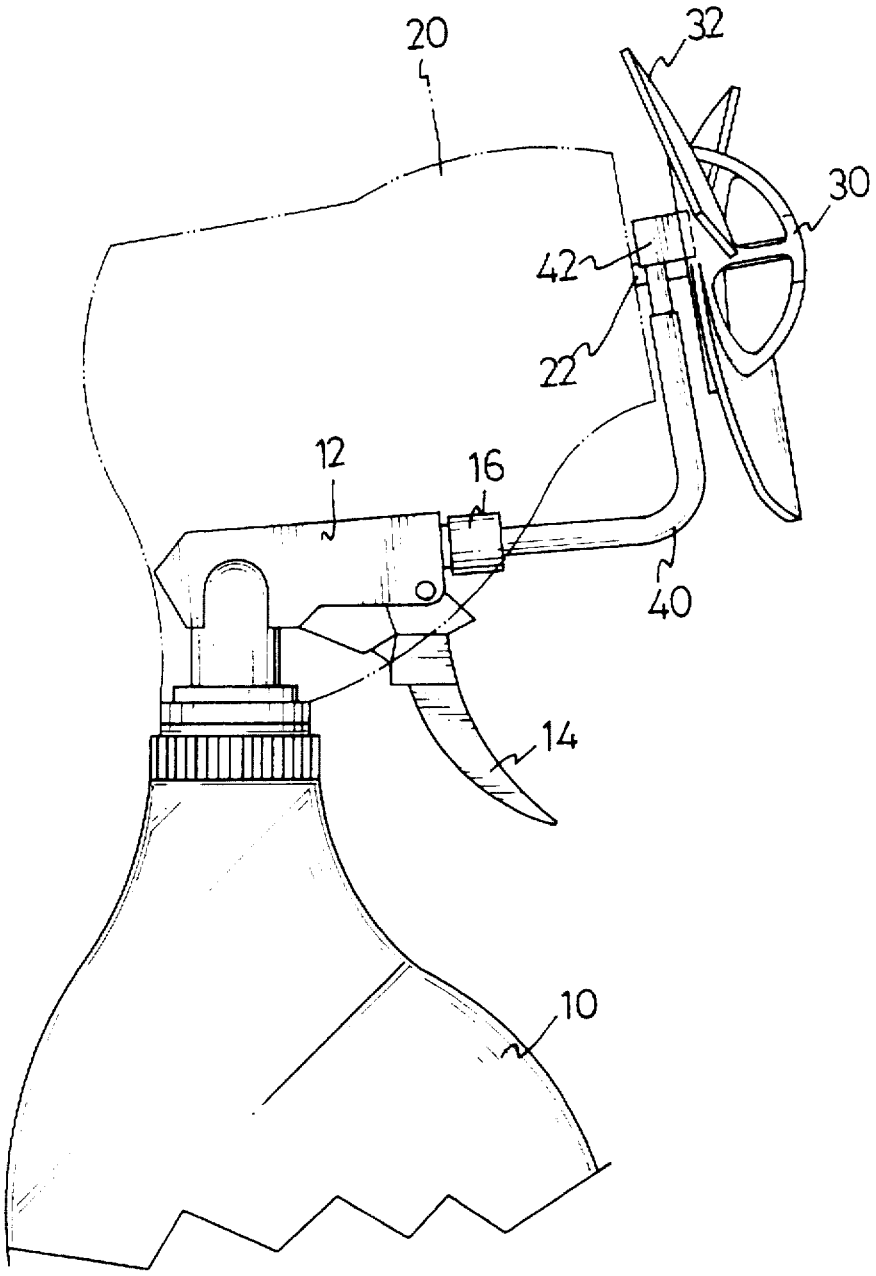
FIG. 1 is a side view showing the structure of the preferred embodiment in accordance with the present invention.

Referring to FIG. 1, there is a side view showing the structure of the preferred embodiment in accordance with the present invention. The atomizer of this invention comprises an atomizing head 12 mounted on a container 10 (the atomizing head 12 may be of a known structure, which comprises a pressure trigger 14 and a spray nozzle 16). A housing 20 is mounted over the atomizing head 12, said housing 20 also may be of a known structure, which encloses a battery set, a switch connected with the battery set, a motor and other relative connect circuit (detailed description is omitted).

Figure 2:
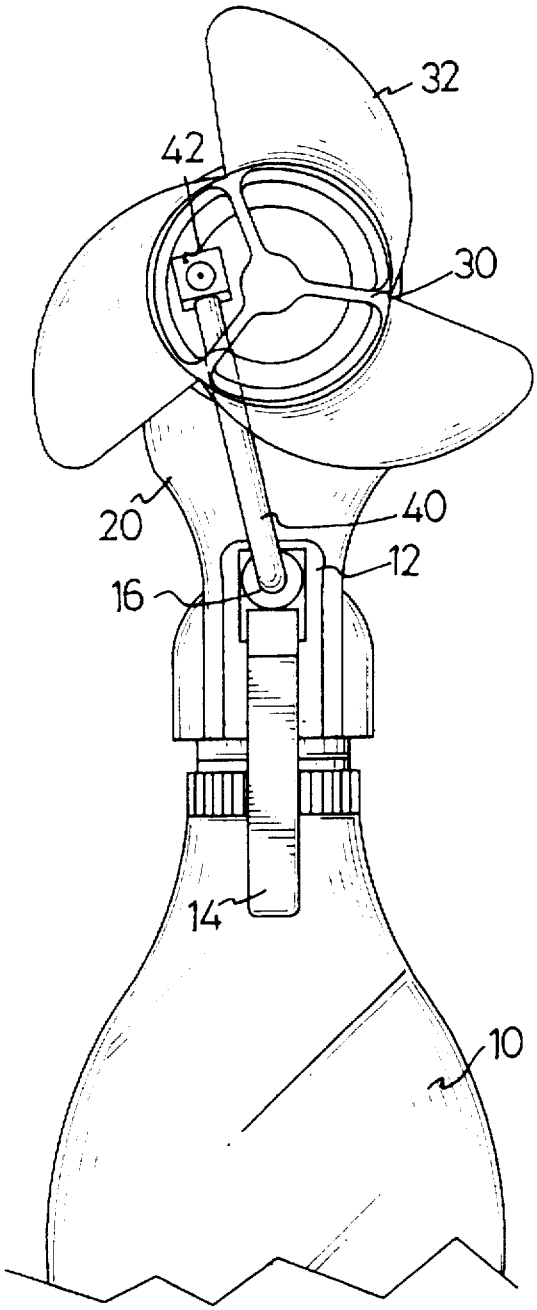
FIG. 2 is a front elevation showing the preferred embodiment in accordance with the present invention.

As shown in FIG. 1 and FIG. 2, the improvement of this invention is that a rotor 30 with a number of blades 32 made of flexible material is mounted in front of the housing 20, said rotor 30 is configured as an frame with a plurality of ribs (not numbered) so that the larger space between the ribs allow the fluid, e.g. water, to be atomized through the rotor to outside with an preferred efficiency. The blades 32 is designed such that a frame for guard is omitted and a need of safe atomizing can be meet.

In addition, a delivery tube 40 is connected between a back of the rotor 30 and the spray nozzle 16 to provide transfer of a fluid, e.g. water, from the container 10 to outside through the space of the rotor 30. One end of the delivery tube 40 is mounted on the spray nozzle 16 and the other end has an orifice 42 mounted in front of the housing 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What the invention claimed is:

1. An atomizer having an atomizing head with a spray nozzle mounted on a container and a housing mounted over the atomizing head, the atomizer further comprising:

a) a rotor rotatably mounted on the housing, the rotor having an annular rim having an open central portion, and a plurality of blades extending outwardly from the annular rim;

b) a device having a spray orifice located adjacent to the rotor such that the spray orifice is located in the open central portion; and, c) a delivery tube connecting the spray orifice to the spray nozzle such that a liquid is sprayed from the spray orifice through the open central portion of the rotor.

2. The atomizer of claim 1 herein the rotor further comprises a plurality of generally radial ribs extending from the annular rim to a hub, the open central portion being formed between the annular rim and the hub.

3. The atomizer of claim 1 wherein the rotor blades are formed of flexible material.

* * * * *